US007030867B2

(12) United States Patent
Takeuchi

(10) Patent No.: US 7,030,867 B2
(45) Date of Patent: Apr. 18, 2006

(54) IMAGE PROCESSING DEVICE FOR ADJUSTING CHARACTERISTIC DATA BASED ON REFERENCE IMAGE AND IMAGE DISPLAY APPARATUS USING THE SAME

(75) Inventor: Kesatoshi Takeuchi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 372 days.

(21) Appl. No.: 10/462,727

(22) Filed: Jun. 17, 2003

(65) Prior Publication Data

US 2004/0021651 A1 Feb. 5, 2004

(30) Foreign Application Priority Data

Jun. 20, 2002 (JP) ..... 2002-179609

(51) Int. Cl.
*G09G 5/00* (2006.01)

(52) U.S. Cl. ..... 345/204; 348/771; 348/581

(58) Field of Classification Search ..... 345/12, 345/20, 212, 672, 698, 677–678; 348/806–807, 348/580–581, 528, 687, 671–673, 745, 771

See application file for complete search history.

(56) References Cited

U.S. PATENT DOCUMENTS

| | | | | |
|---|---|---|---|---|
| 4,868,668 | A * | 9/1989 | Tavernetti | 348/745 |
| 5,742,274 | A * | 4/1998 | Henry et al. | 345/698 |
| 5,790,096 | A * | 8/1998 | Hill, Jr. | 345/600 |
| 6,342,898 | B1 * | 1/2002 | Pettitt | 345/601 |
| 2001/0035870 | A1 * | 11/2001 | Takeuchi et al. | 345/630 |

* cited by examiner

*Primary Examiner*—Kent Chang
*Assistant Examiner*—Joseph Maresca
(74) *Attorney, Agent, or Firm*—Oliff & Berridge, PLC.

(57) ABSTRACT

In an image display apparatus of the present invention, at a predetermined timing, a characteristic data setting module actuates a reference image signal generation module to generate an analog reference image signal, based on reference image data prepared in advance. The characteristic data setting module then controls a signal selector module to select the analog reference image signal. An A-D converter module converts the analog reference image signal selected by the signal selector module into a digital image signal according to preset characteristic data. The characteristic data setting module adjusts the characteristic data set in the A-D converter module to make image data expressed by the digital image signal input from the A-D converter module into an image conversion processing module approach to the reference image data. This arrangement ensures easy adjustment of the operating characteristics of the image display apparatus.

7 Claims, 8 Drawing Sheets

IMAGE PROCESSING DEVICE FOR ADJUSTING CHARACTERISTIC DATA BASED ON REFERENCE IMAGE AND IMAGE DISPLAY APPARATUS USING THE SAME

BACKGROUND OF THE INVENTION

1. Field of the Invention

The present invention relates to a technique that automatically adjusts operating characteristics of an image display apparatus.

2. Description of the Related Art

Liquid crystal panels and DMDs™ (digital micro-mirror devices: trademark by TI Inc.), spatial light modulators, are widely used as image display devices in projectors. Liquid crystal panels and PDPs (plasma display panels) are also widely used as direct view image display devices.

An image processing device included in an image display apparatus with such a display device digitizes input analog image signals and makes the digital image signals subjected to various series of image processing. Images expressed by the image signals output from the image processing device are displayed on the display device. The image processing device has diverse electronic circuits including an A-D converter to digitize the input analog image signals.

The image processing apparatus includes analog devices, such as a switch for selecting image signals, a video amplifier, and an A-D converter. The difference in damping characteristic of the image signal among these analog devices or the difference in damping characteristic among RGB color signals causes a variation in luminance characteristic. The variation deteriorates the linearity of the luminance characteristic and the color reproducibility. The deterioration may worsen the quality of the display characteristics. In order to ensure the constant display characteristics, one proposed technique inputs a reference image signal as an analog image signal into each image display apparatus and carries out adjustment to ensure the optimum A-D conversion characteristics set in the A-D converter and the optimum display characteristics set in the display device at the time of assembly of the image display apparatus.

Among the operating characteristics of the image display apparatus, the A-D conversion characteristics of the A-D converter and the display characteristics of the display device, however, often vary with time and especially by aging. Adjustment at only the time of assembly may thus be insufficient. The operating characteristics of the image display apparatus also vary with seasons or with the working environments. Such variations may also make the initial adjustment insufficient.

It is thus highly demanded to make the operating characteristics of the image display apparatus readily adjustable even after shipment, as well as at the time of assembly of the image display apparatus.

SUMMARY OF THE INVENTION

The object of the present invention is thus to solve the drawbacks of the prior art techniques discussed above and to provide a technique of ensuring easy adjustment of operating characteristics in an image display apparatus even after shipment as well as at the time of assembly of the image display apparatus.

In order to attain at least part of the above and other related objects, a first application of the present invention is directed to an image display apparatus that displays an image in response to an input image signal. The image display apparatus has: an image display unit that displays an image based on a preset image signal; and an image processing unit that processes the input image signal and outputs the preset image signal.

The image processing unit includes: a reference image signal generation module that generates an analog reference image signal, based on reference image data prepared in advance; a signal selector module that selects either one of an analog input image signal and the analog reference image signal; an A-D converter module that converts either of the analog input image signal and the analog reference image signal selected by the signal selector module into a digital image signal according to preset characteristic data; an image conversion processing module that generates the preset image signal, based on the digital image signal input from the A-D converter module; a storage module that stores data, which corresponds to the characteristic data set in the A-D converter module, in an updatable manner; and a characteristic data setting module that sets the data stored in the storage module as the characteristic data in the A-D converter module.

At a predetermined timing, the characteristic data setting module actuates the reference image signal generation module to generate the analog reference image signal, controls the signal selector module to select the analog reference image signal, adjusts the characteristic data set in the A-D converter module to make image data expressed by the digital image signal input from the A-D converter module into the image conversion processing module approach to the reference image data, and updates the data stored in the storage module.

In the image display apparatus of the above structure, the characteristic data set in the A-D converter are adjustable at the predetermined timing. The predetermined timing may be any of various timings, for example, a timing of a fixed time interval, a timing in response to a user's input of an adjustment instruction, a timing of initialization, or a startup timing. The arrangement of the present invention described above enables the operating characteristics of the image display apparatus to be readily adjusted even after shipment as well as at the time of assembly of the image display apparatus.

In one preferable embodiment of the image display apparatus, the reference image signal generation module has: a reference image data generation sub-module that generates the reference image data according to a format of the analog input image signal and outputs the generated reference image data as the digital reference image signal; and a D-A converter sub-module that converts the digital reference image signal into the analog reference image signal.

In this embodiment, the reference image data generation sub-module may be included in the image conversion processing module, and the D-A converter sub-module may function to convert the digital reference image signal input as the preset image signal from the image conversion processing module into the analog reference image signal.

In the image display apparatus of any of the above structures, the characteristic data setting module may adjust only a specified part of multiple data, which are included in the characteristic data.

This arrangement allows for adjustment of only one or multiple desired operating characteristics.

A second application of the present invention is directed to an image processing apparatus, which includes: a reference image signal generation module that generates an analog reference image signal, based on reference image data prepared in advance; a signal selector module that selects either one of an analog input image signal and the analog reference image signal; an A-D converter module that converts either of the analog input image signal and the analog reference image signal selected by the signal selector module into a digital image signal according to preset characteristic data; an image conversion processing module that generates a preset image signal, based on the digital image signal input from the A-D converter module; a storage module that stores data, which corresponds to the characteristic data set in the A-D converter module, in an updatable manner; and a characteristic data setting module that sets the data stored in the storage module as the characteristic data in the A-D converter module.

At a predetermined timing, the characteristic data setting module actuates the reference image signal generation module to generate the analog reference image signal, controls the signal selector module to select the analog reference image signal, adjusts the characteristic data set in the A-D converter module to make image data expressed by the digital image signal input from the A-D converter module into the image conversion processing module approach to the reference image data, and updates the data stored in the storage module.

Application of the image processing device of such structure to the image display apparatus enables the operating characteristics of the image display apparatus to be readily adjusted even after shipment, as well as at the time of assembly of the image display apparatus.

These and other objects, features, aspects, and advantages of the present invention will become more apparent from the following detailed description of the preferred embodiments with the accompanying drawings.

DESCRIPTION OF THE PREFERRED EMBODIMENTS

Some modes of carrying out the invention are discussed below as preferred embodiments in the following sequence:

A. First Embodiment

A1. General Construction of Image Display Apparatus

A2. Adjustment of Operating Characteristics

B. Second Embodiment

A. First Embodiment

A1. General Construction of Image Display Apparatus

Figure 1:
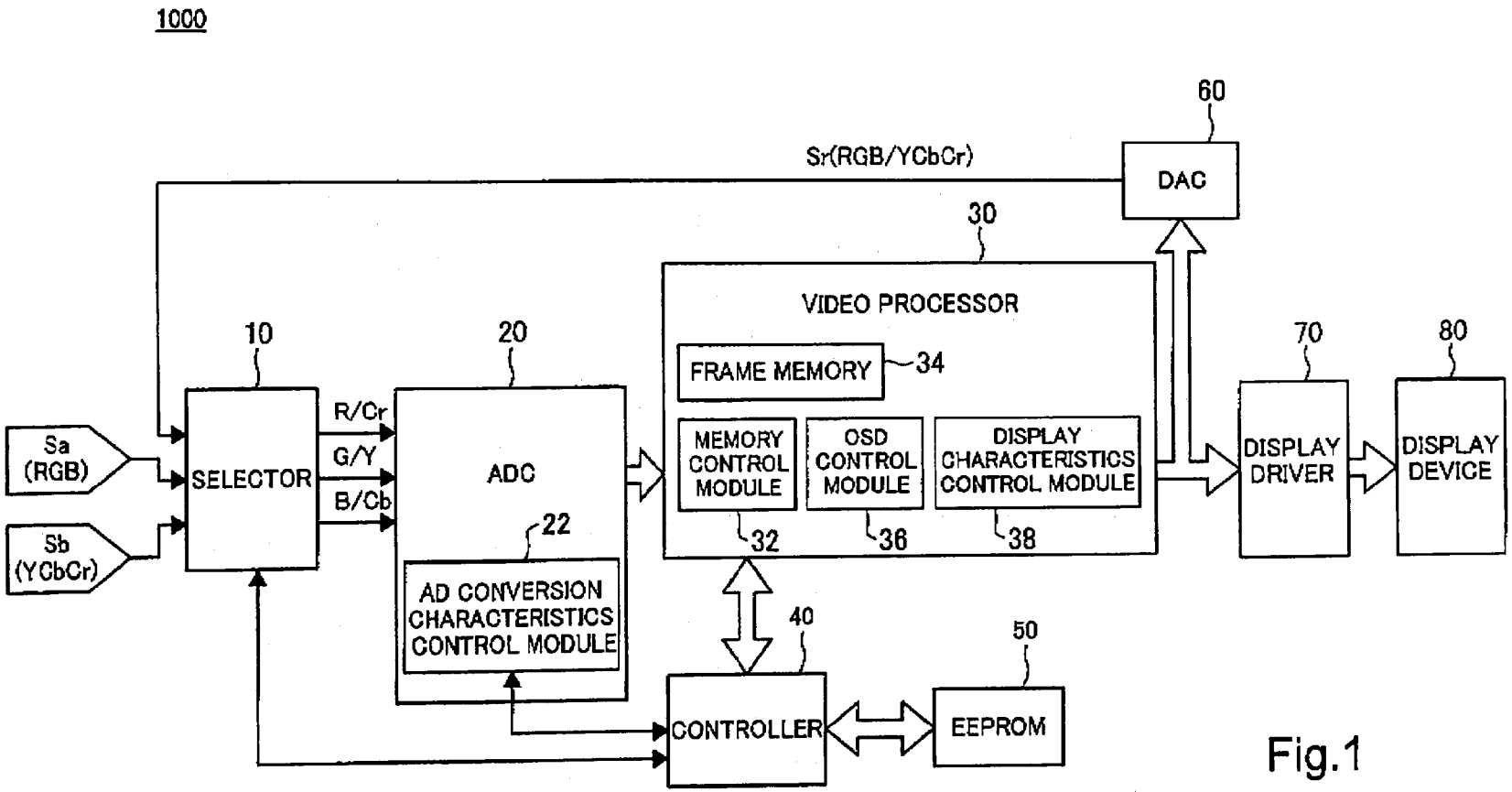
FIG. 1 is a block diagram schematically illustrating the structure of an image display apparatus in a first embodiment of the present invention.

FIG. 1 is a block diagram schematically illustrating the structure of an image display apparatus 1000 in a first embodiment of the present invention. The image display apparatus 1000 includes a selector 10, an A-D converter (ADC) 20, a video processor 30, a controller 40, an EEPROM 50, and a DA converter (DAC) 60 as constituents of an image processing unit. The image display apparatus 1000 also includes a display driver 70 and a display device 80 as constituents of an image display unit. A driver suitable for the display device 80 is used as the display driver 70. In the structure of this embodiment, the display device 80 is a liquid crystal panel, and a driver for actuating the liquid crystal panel is applied for the display driver 70.

In one preferable example, a liquid crystal panel or a DMD™ is applied for the display device 80, and the image display apparatus 1000 is constructed as a projector, which includes an illumination unit for illuminating the display device 80 and a projection optical system that projects light rays, which are emitted from the display device 80 to represent an image (image light rays), on a screen.

The controller 40 is a computer including a CPU, a RAM, and a ROM (none of the constituents is shown). The controller 40 controls the operations of the respective blocks, the selector 10, the A-D converter 20, the video processor 30, and the EEPROM 50. The controller 40, for example, sets data stored in the EEPROM 50 as characteristic data representing A-D conversion characteristics of the A-D converter 20 and display characteristics of the display device 80 in the A-D converter 20 and in the video processor 30. The controller 40 adjusts the characteristic data set in the A-D converter 20 and in the video processor 30, so as to regulate A-D conversion characteristics of the A-D converter 20 and the display characteristics of the display device 80 determined according to the characteristic data and store the adjusted characteristic data into the EEPROM 50. The controller 40 the EEPROM 50 respectively correspond to the characteristic data setting module and the storage module of the present invention.

The selector 10 selects one of externally input two signals, that is, an analog input image signal Sa of an RGB format and an analog input image signal Sb of a YCbCr format, in response to an instruction transmitted from the controller 40. The selector 10 also selects either one of the externally input image signal Sa or Sb and a reference image signal Sr input from the D-A converter 60, in response to an instruction transmitted from the controller 40. The format of the reference image signal Sr may follow the RGB format or the YCbCr format. In the process of normal operations, the selector 10 selects one of the externally input two signals, the analog input image signal Sa of the RGB format and the analog input image signal Sb of the YCbCr format. In the process of adjustment of the operating characteristics described later, the selector 10 selects the reference image signal Sr.

The A-D converter 20 converts the analog input image signal Sa or Sb or the analog reference image signal Sr (hereafter may simply be referred to as 'input analog image signal') into a digital image signal according to the characteristic data set by the controller 40. The input analog image signal following the RGB format includes luminance signals of three colors R, G, and B. The input analog image signal following the YCbCr format, on the other hand, includes a luminance signal Y and two color difference signals Cb and Cr. The input analog image signal of the YCbCr format may be a signal of another format like a YPbPr format including a luminance signal and color difference signals.

The A-D converter 20 includes an A-D conversion characteristics control module 22 for controlling A-D conversion characteristics. The A-D conversion characteristics control module 22 controls the A-D conversion characteristics, based on given characteristic data.

The characteristic data, which are stored in advance in the EEPROM 50, are read out and supplied to the A-D converter 20 by the controller 40. The characteristic data may be data representing a bottom level corresponding to a black level of the input image signal, data representing a top level corresponding to a white level of the input image signal, or data representing a gain corresponding to a difference between the bottom level and the top level. These are, however, only examples and not restrictive in any sense. Various data may be used as the characteristic data according to a control procedure of the A-D conversion characteristics set in the A D conversion characteristics control module 22 included in the A-D converter 20. Any of diverse known A-D converters may be applicable for the A-D converter 20. One available example for the A-D converter 20 is an A-D converter THC7116 manufactured by THine Electronics Inc.

In the video processor 30, a memory control module 32 controls writing operations of digital image signals input from the A-D conversion circuit 20 into a frame memory 34 and reads out data written in the frame memory 34. In these writing and reading processes, the memory control module 32 carries out required series of image processing, for example, conversion into image signals of a specific format that can be supplied to the display device 80 and expansion or contraction of images. Available examples for the video processor 30 include video processors PW164 and PW364 manufactured by Pixelworks, Inc. The video processor 30 corresponds to the image conversion processing module of the present invention. Reference image data supplied from the controller 40 are written in the frame memory 34 as described later. In the process of adjustment of the operating characteristics, the procedure reads the reference image data written in the frame memory 34 and generates a digital reference image signal as an image signal output from the video processor 30. The generated digital reference image signal is converted into the analog reference image signal Sr by the D-A converter 60 and is input into the selector 10. The frame memory 34, the memory control module 32, and the D-A converter 60 correspond to the reference image signal generation module of the present invention.

A display characteristics control module 38 of the video processor 30 controls various display characteristics, for example, brightness, contrast, γ characteristic, and chromaticity of an image displayed on the display device 80 according to the characteristic data (display characteristic data) set by the controller 40.

An OSD control module 36 of the video processor 30 functions to overlay, for example, a menu window on an image expressed by the image signal read from the frame memory 34, based on data stored in a storage module (not shown).

The image signal output from the video processor 30 is given as a display image signal to the display driver 70. The display driver 70 generates a driving signal to drive the display device 80 in response to the given image signal. The display device 80 displays an image in response to the given driving signal.

A2. Adjustment of Operating Characteristics

Adjustment of the A-D conversion characteristics in the A-D conversion characteristics control module 22 of the A-D converter 20 and the display characteristics in the display characteristics control module 38 is automatically executed at preset timings, for example, at preset time intervals counted by an internal timer of the controller 40. Alternatively such adjustment is executed at a timing of the user's selection of an option 'automatic adjustment control' on a menu window displayed by the OSD control module 36 controlled via the controller 40. The adjustment may otherwise be executed at a timing of initializing the apparatus, for example, at a startup timing of the apparatus.

Figure 2:
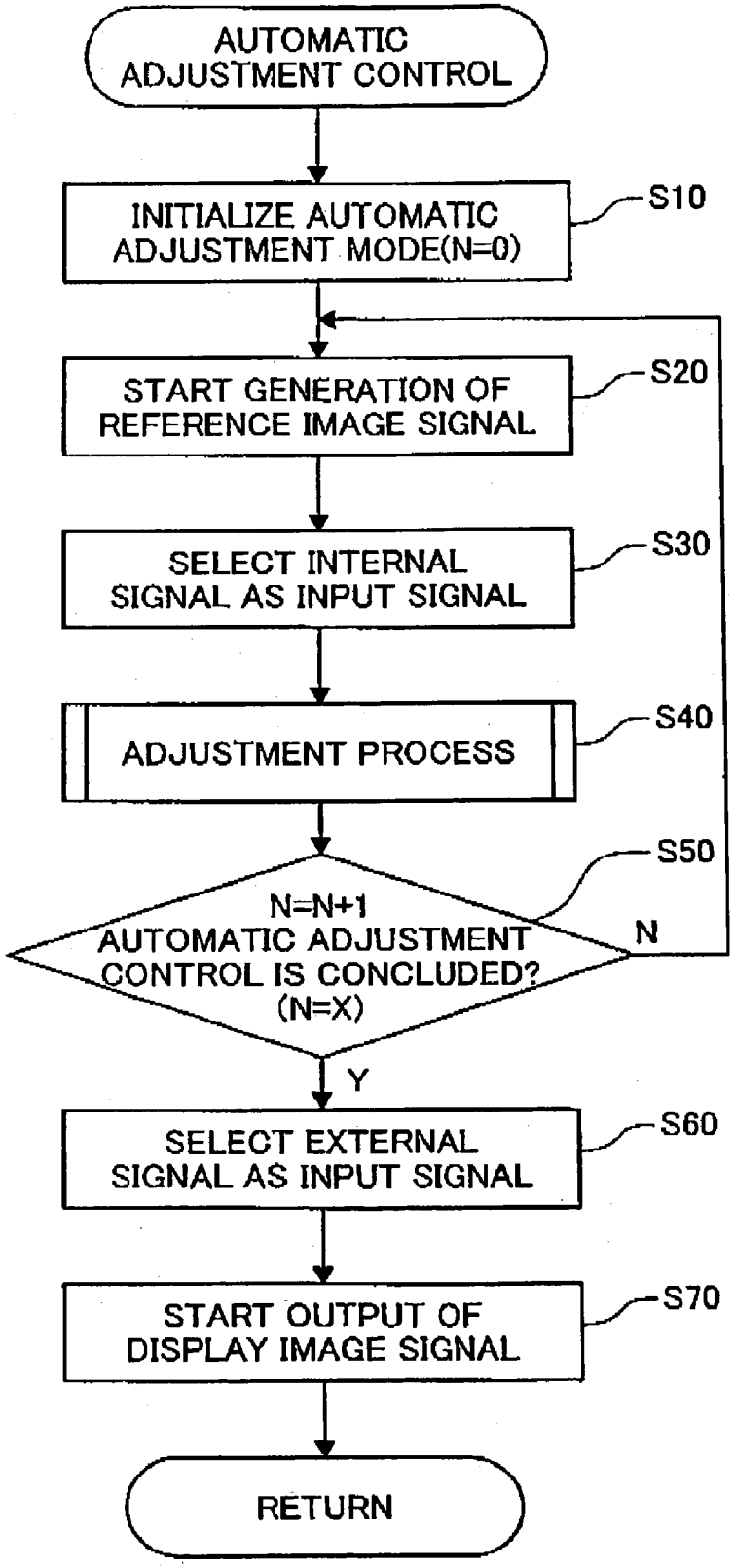
FIG. 2 is a flowchart showing an automatic adjustment control routine executed by a controller included in the image display apparatus of FIG. 1.

FIG. 2 is a flowchart showing an automatic adjustment control routine executed by the controller 40. When the automatic adjustment control routine starts, a parameter N representing an option of automatic adjustment (automatic adjustment mode) is initialized to zero (N=0) at step S10. Generation of a reference image signal starts at step S20. The memory control module 32 functions to write the reference image data, which is supplied from the controller 40, into the frame member 34. A concrete procedure of step S20 causes the memory control module 32 to read the reference image data written in the frame memory 34 and to start generation of a digital reference image signal. The generated digital reference image signal is output as a display image signal from the video processor 30.

Figure 3:
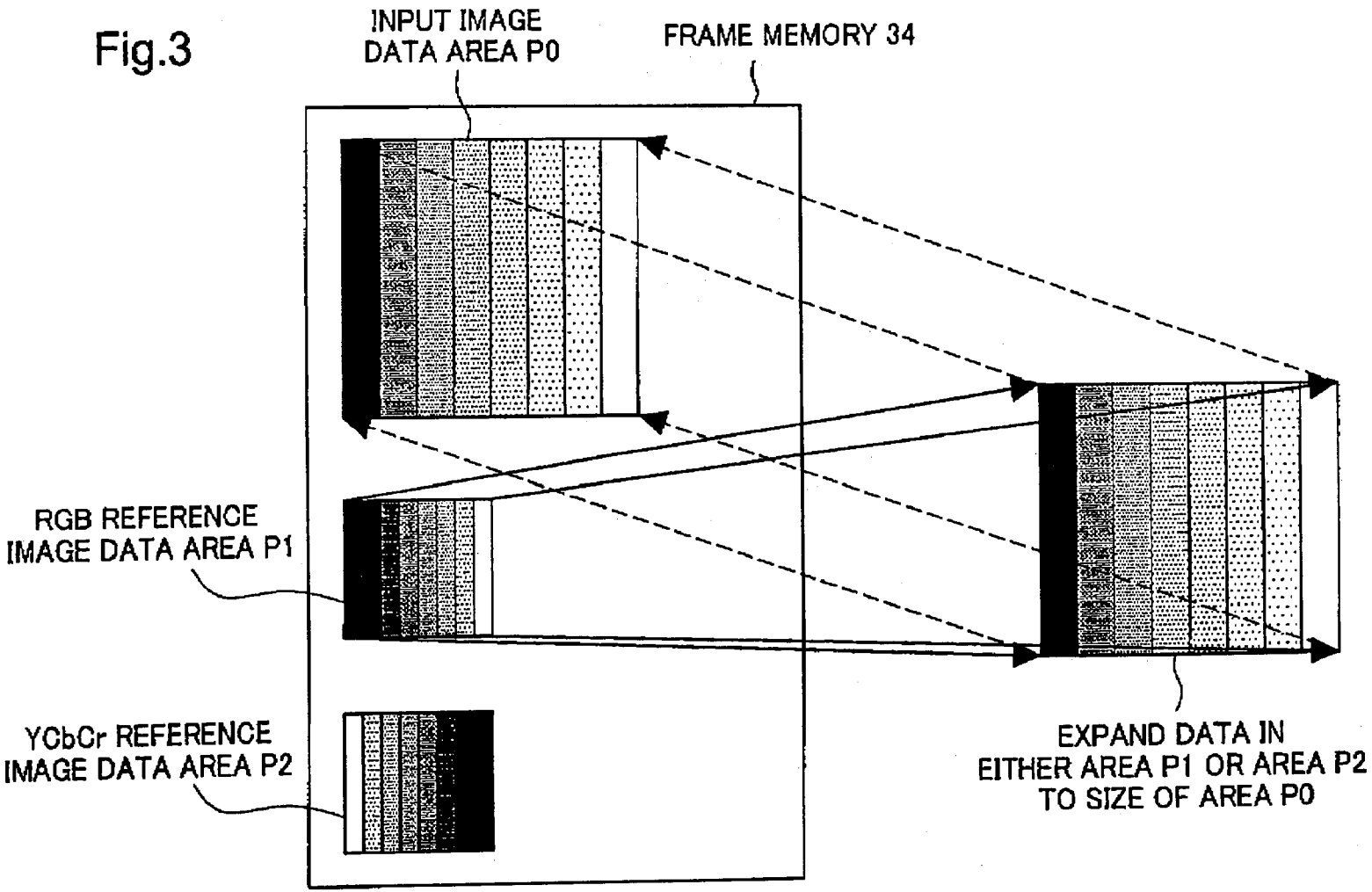
FIG. 3 shows an example of reference image data laid in a frame memory.

FIG. 3 shows an example of the reference image data laid in the frame memory 34. In the illustrated example of FIG. 3, the frame memory 34 is divided into an area P0 where the input image data supplied from the A-D converter 20 are laid (input image data area), an area P1 where RGB reference image data are laid (RGB reference image data area), and an area P2 where YCbCr reference image data are laid (YCbCr reference image data area).

The controller 40 generates the RGB reference image data and the YCbCr reference image data. The RGB reference image data and the YCbCr reference image data thus generated are laid in the corresponding RGB reference image data area P1 and YCbCr reference image data area P2. The RGB reference image data is, for example, image data representing a gray scale (hereafter simply referred to as 'gray scale data'). The YCbCr reference image data is, for example, image data representing a color bar (hereafter simply referred to as 'color bar data'). In the illustrated example of FIG. 3, the controller 40 lays the gray scale data and the color bar data in the corresponding reference image data areas P1 and P2 as minimum necessary data areas. The video processor 30 expands the data laid in the reference image data areas P1 and P2 to the size of the input image data area P0 and outputs the expanded data.

The reference image data laid in the frame memory 34 is output as the digital reference image signal from the video processor 30. In the case of adjustment of the operating characteristics with regard to the input image signal of the RGB format, the RGB reference image data laid in the RGB reference image data area P1 is output. In the case of adjustment of the operating characteristics with regard to the input image signal of the YCbCr format, on the other hand, the YCbCr reference image data laid in the YCbCr reference image data area P2 is output. The output digital reference image signal is converted into the analog reference image signal Sr by the D-A converter 60.

Referring back to the flowchart of FIG. 2, at step S30, the controller 40 controls the selector 10 not to select either of the externally input image signals Sa and Sb (external signals) but to select the reference image signal Sr (internal signal) output from the D-A converter 60, as the input signal into the A-D converter 20. The reference image signal Sr is output from the D-A converter 60 as analog conversion of the digital reference image signal, which is generated by the video processor 30 according to the data laid in the frame memory 34 by the controller 40 at step S20.

Image data included in the digital reference image data subjected to A-D conversion by the A-D converter 20 are laid in the input image data area P0 of the frame memory 34 (see FIG. 3).

Figure 4:
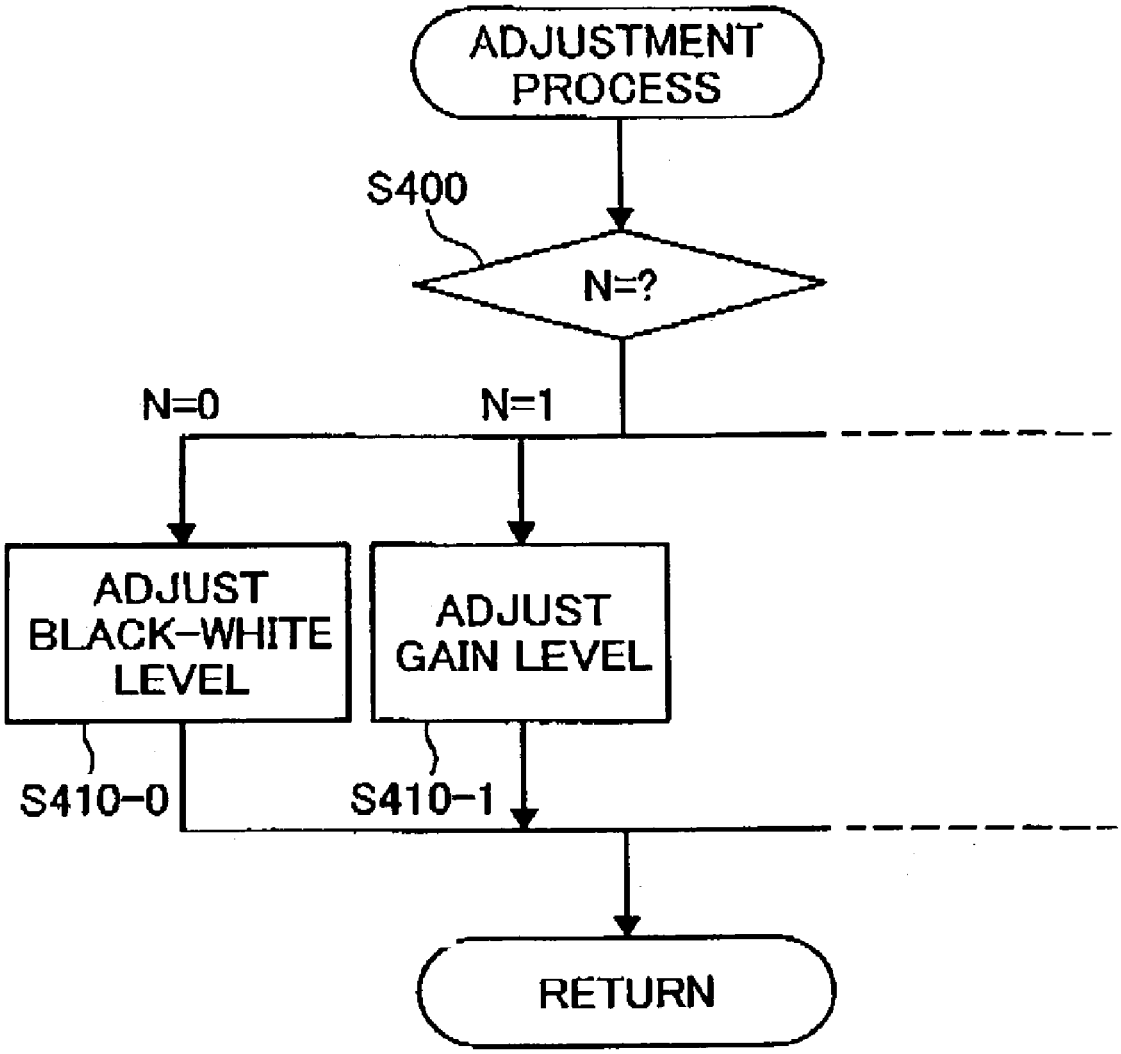
FIG. 4 is a flowchart showing the details of the adjustment process executed at step S40 in the automatic adjustment control routine of FIG. 2.

An adjustment process according to the value of the parameter N is carried out at step S40. FIG. 4 is a flowchart showing a routine of the adjustment process executed at step S40. The adjustment process routine executes the adjustment process according to the value of the parameter N. The routine first specifies the value of the parameter N at step S400 and executes the processing of one of steps S410-0, S410-1, . . . , according to the specified value of the parameter N=0, 1, . . . . For example, at the value of the parameter N=0, adjustment of a black-white level is executed as an A-D conversion characteristic set in the A-D converter 20 via the A-D conversion characteristic control module 22. At the value of the parameter N=1, adjustment of a gain level is carried out. At the value of the parameter N=2 and subsequent values, adjustment of an intermediate luminance level as the gamma characteristic is executed as a display characteristic set in the display device 80.

Figure 5A:
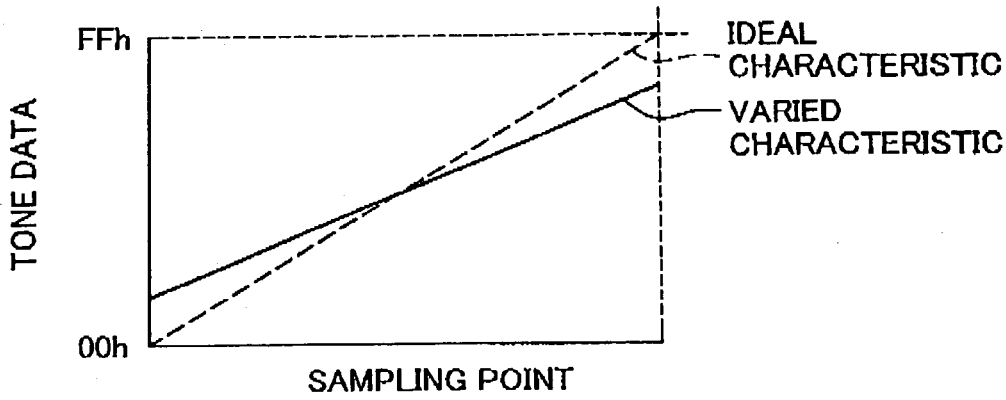
FIGS. 5(A) through (C) show adjustment of A-D conversion characteristics in an A-D converter included in the image display apparatus of FIG. 1.
Figure 5B:
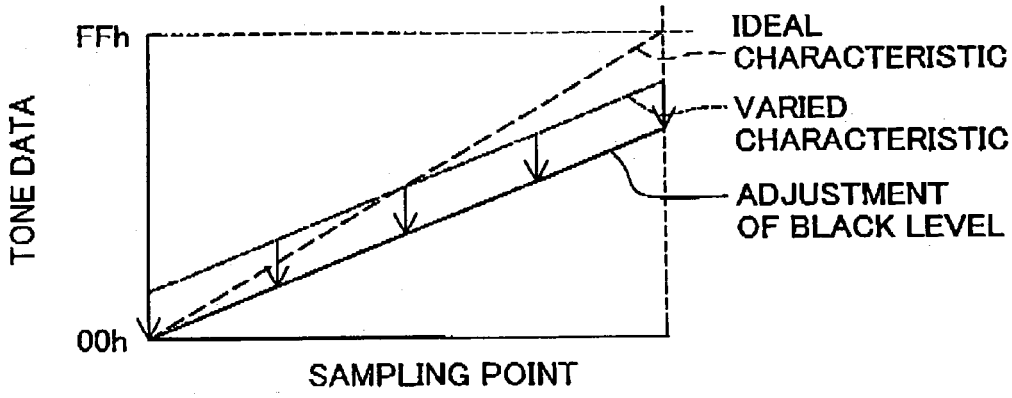
Figure 5C:
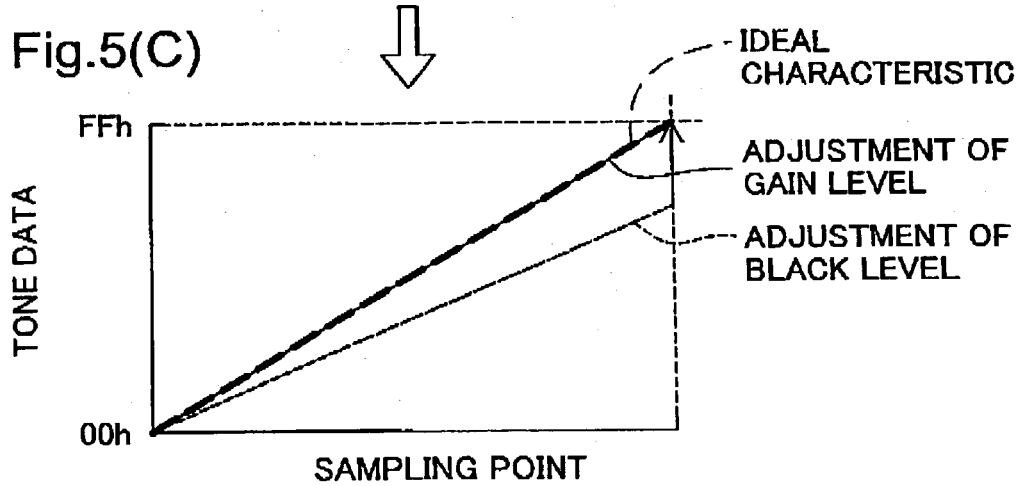

FIGS. 5(A) through (C) show adjustment of the A-D conversion characteristics in the A-D converter 20. Here it is assumed that the digital image signal output from the A-D converter 20 is 8-bit image data. As mentioned above, the image data included in the reference image signal is gray scale data, which sequentially varies from the black level to the white level.

It is ideal that the image data output from the A-D converter 20 linearly varies from '00h' to 'FFh' (where h represents hexadecimal notation) as shown in FIG. 5. In the actual state, however, individual variations in the respective circuits constituting the selector 10 and the A-D converter 20 may cause the actual characteristic to be deviated from the ideal characteristic as shown in FIG. 5(A). In such cases, the automatic adjustment control described above first adjusts the black level to set the image data corresponding to the black level equal to '00h', among the image data output from the A-D converter 20, as shown in FIG. 5(B). The automatic adjustment control then adjusts the white level to set the image data corresponding to the white level equal to 'FFh', among the image data output from the A-D converter 20, as shown in FIG. 5(C). The concrete procedure adjusts the gain level to regulate the amplitude of the white level relative to the amplitude of the black level of the analog image signal, which is subjected to A-D conversion.

The positional mapping of the reference image data laid in the reference image data areas P1 and P2 of the frame memory 34 to the image data in the input image data area P0 (see FIG. 3) is known. The controller 40 thus readily grasps the values of the image data corresponding to the black level and the white level by simply reading the image data at the corresponding positions in the input image data area P0.

Referring back to the flowchart of FIG. 2, at step S50, the controller 40 increments the value of the parameter N by one and determines whether or not the incremented value of the parameter N is equal to X. Here X represents the number of characteristics to be adjusted by the adjustment process of step S40. Namely the procedure determines whether or not all the automatic adjustments have been concluded at step S50.

When all the automatic adjustments have not yet been concluded, the program returns to step S20 and executes a next series of the adjustment process corresponding to the incremented value of the parameter N (see FIG. 4). When all the automatic adjustments have been concluded, on the other hand, the program goes to step S60, at which the controller 40 controls the selector 10 to select the externally input image signal (external signal) as the input signal into the A-D converter 20.

At subsequent step S70, the image signal (display image signal) corresponding to the externally input image signal is output from the video processor 30 to start a general display operation.

As described above, in the image display apparatus 1000 of the first embodiment, the controller 40 executes automatic adjustment at the predetermined timing as described above. The characteristic data supplied to the A-D conversion characteristics control module 22, which controls the A-D conversion characteristics of the A-D converter 20, are regulated by utilizing the reference image signal generated by the reference image signal generation module as the input image signal. Regulation of the characteristic data adjusts the image data input from the A-D converter 22 into the frame memory 34 of the video processor 30 to approach to or ideally to become equal to the image data expressed by the reference image signal. The display characteristics are adjustable by regulating the characteristic data supplied to the display characteristic control module 38, which controls the display characteristics of the display device 80. The structure of the first embodiment thus enables the operating characteristics of the image display apparatus 1000 to be readily adjusted even after shipment, as well as at the time of assembly of the image display apparatus 1000.

In the automatic adjustment control routine shown in the flowchart of FIG. 2, the adjustment process of step S40 executes adjustment of all the adjustable characteristics. This is, however, not restrictive at all but is only illustrative. For example, one modified procedure selects one or multiple desired characteristics among all the adjustable characteristics with selection of the 'automatic adjustment control' option on the menu window and executes adjustment of only the selected characteristics. In this case, the processes of steps S10 and S50 in the automatic adjustment control routine of FIG. 2 should be modified to the processes of setting only the values of the parameter N corresponding to the selected characteristics. Such modification is readily executable by the skilled in the art and is not specifically described here.

In the illustrated example of FIG. 3, the reference image data is the gray scale data or the color bar data having the size identical with the size of the input image data area P0. This is, however, not restrictive at all but is only illustrative. The reference image data may be any data usable as a reference signal for adjustment of the A-D conversion characteristic and the display characteristics. Some more examples of the reference image data are given below.

Figure 6A:
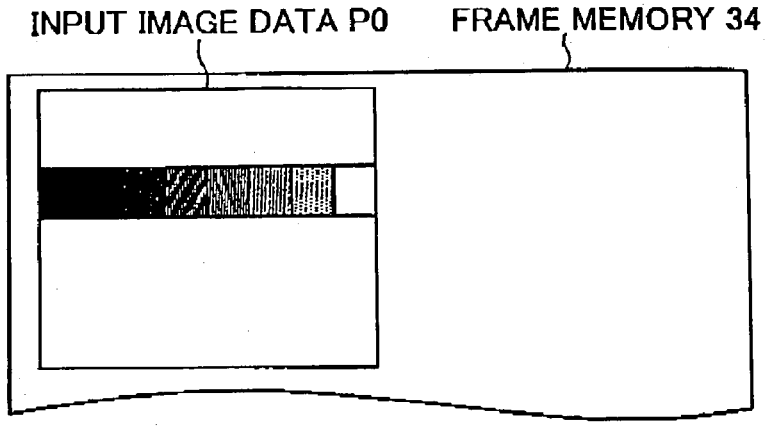
FIGS. 6(A) through (C) show a modified example of the reference image data.
Figure 6B:
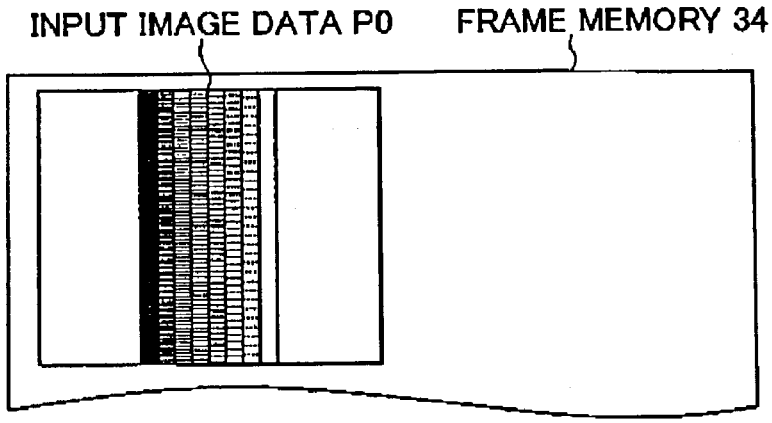
Figure 6C:
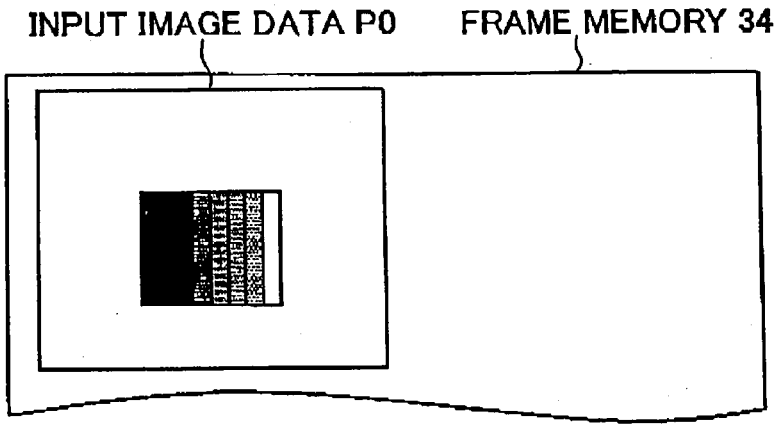
Figure 7:
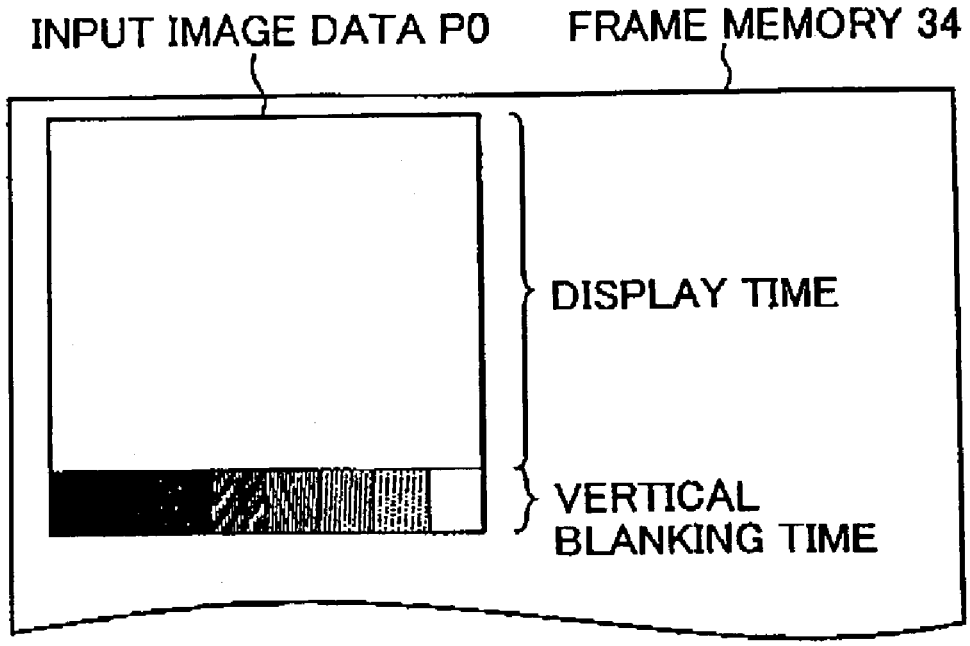
FIG. 7 shows another modified example of the reference image data.

FIGS. 6(A) through (C) and 7 show modified examples of the reference image data. In the illustration of these modified examples, reference image data expressed by each generated reference image signal is laid in the input image data area P0 of the frame memory 34 via the A-D convertor 20. In the illustrated example of FIG. 3, the gray scale data or the color bar data having a size identical with the size of the input image data area P0 are laid in the input image data area P0 of the frame memory 34 via the A-D converter 20. The reference image data may alternatively be laid in part of the input image data area P0. In the example of FIG. 6(A), the gray scale data or the color bar data are laid in only a range of partial rows in the reference image data area P0. In the example of FIG. 6(B), the gray scale data or the color bar data are laid in only a range of partial columns in the reference image data area P0. In the example of FIG. 6(C), the gray scale data or the color bar data are laid in only a range of partial rows and partial columns in the reference image data area P0. In the example of FIG. 7, the reference image data are laid in only a range corresponding to a vertical blanking time, which is below a range corresponding to an image display time, in the input image data area P0.

The OSD control module 36 may be utilized as the reference image signal generation module. In this modified structure, the OSD control module 36 displays the menu window and generates a digital reference image signal based on the reference image data stored in advance in the OSD control module 36.

B. Second Embodiment

Figure 8:
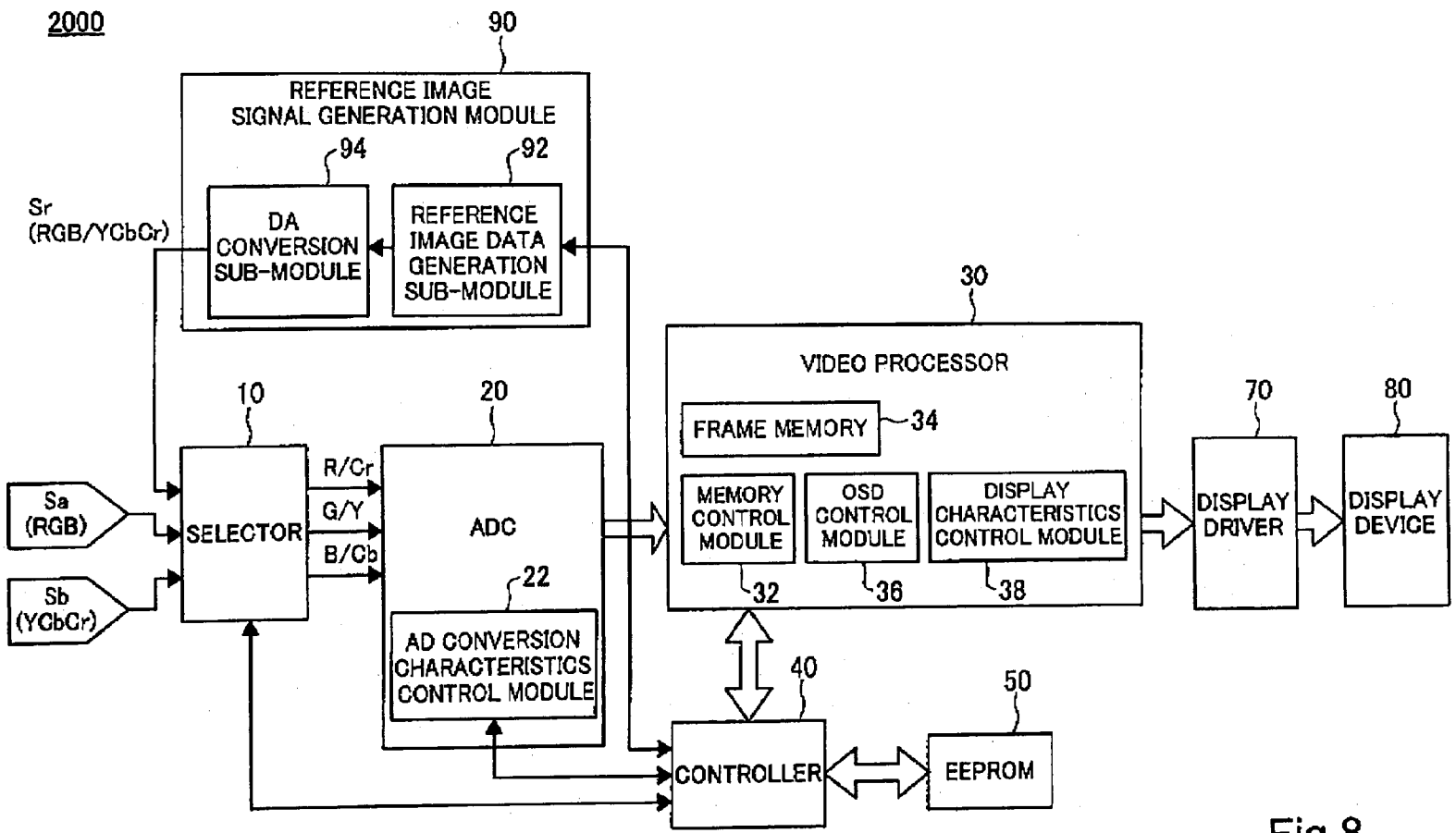
FIG. 8 is a block diagram schematically illustrating the structure of another image display apparatus in a second embodiment of the present invention.

FIG. 8 is a block diagram schematically illustrating the structure of another image display apparatus 2000 in a second embodiment of the present invention. The only difference from the image display apparatus 1000 of the first embodiment is that the image display apparatus 2000 of the second embodiment has a reference image signal generation module 90 as a separate constituent.

The reference image signal generation module 90 has a reference image data generation sub-module 92 and a D-A conversion sub-module 94. Like the first embodiment, the reference image data generation sub-module 92 lays the reference image data in an internal memory (not shown) in response to an instruction from the controller 40. The reference image data laid in the memory is output as a reference image signal Sr via the D-A conversion sub-module 94, which has the same functions as those of the D-A converter 60 included in the image display apparatus 1000 of the first embodiment.

Like the image display apparatus 1000 of the first embodiment, the structure of the second embodiment enables the operating characteristics of the image display apparatus 2000 to be readily adjusted even after shipment, as well as at the time of assembly of the image display apparatus 2000.

The reference image signal generation module 90 may not be constructed as the separate constituent but may be incorporated in another suitable block.

The above embodiments are to be considered in all aspects as illustrative and not restrictive. There may be many modifications, changes, and alterations without departing from the scope or spirit of the main characteristics of the present invention All changes within the meaning and range of equivalency of the claims are therefore intended to be embraced therein.

The scope and spirit of the present invention are indicated by the appended claims, rather than by the foregoing description.

What is claimed is:

1. An image display apparatus that displays an image in response to an input image signal, the image display apparatus comprising:

an image display unit that displays an image based on a preset image signal; and an image processing unit that processes the input image signal and outputs the preset image signal, the image processing unit comprising:

a reference image signal generation module that generates an analog reference image signal, based on reference image data prepared in advance;

a signal selector module that selects either one of an analog input image signal and the analog reference image signal;

an A-D converter module that converts either of the analog input image signal and the analog reference image signal selected by the signal selector module into a digital image signal according to preset characteristic data;

an image conversion processing module that generates the preset image signal, based on the digital image signal input from the A-D converter module;

a storage module that stores data, which corresponds to the characteristic data set in the A-D converter module, in an updatable manner; and a characteristic data setting module that sets the data stored in the storage module as the characteristic data in the A-D converter module, at a predetermined timing, the characteristic data setting module actuating the reference image signal generation module to generate the analog reference image signal, controlling the signal selector module to select the analog reference image signal, adjusting the characteristic data set in the A-D converter module to make image data expressed by the digital image signal input from the A-D converter module into the image conversion processing module approach to the reference image data, and updating the data stored in the storage module.

2. An image display apparatus in accordance with claim 1, wherein the reference image signal generation module comprises:

a reference image data generation sub-module that generates the reference image data according to a format of the analog input image signal and outputs the generated reference image data as the digital reference image signal; and a D-A converter sub-module that converts the digital reference image signal into the analog reference image signal.

3. An image display apparatus in accordance with claim 2, wherein the reference image data generation sub-module is included in the image conversion processing module, and the D-A converter sub-module converts the digital reference image signal input as the preset image signal from the image conversion processing module into the analog reference image signal.

4. An image display apparatus in accordance with claim 3, wherein the characteristic data setting module adjusts only a specified part of multiple data, which are included in the characteristic data.

5. An image display apparatus in accordance with claim 2, wherein the characteristic data setting module adjusts only a specified part of multiple data, which are included in the characteristic data.

6. An image display apparatus in accordance with claim 1, wherein the characteristic data setting module adjusts only a specified part of multiple data, which are included in the characteristic data.

7. An image processing apparatus, comprising:

a reference image signal generation module that generates an analog reference image signal, based on reference image data prepared in advance;

a signal selector module that selects either one of an analog input image signal and the analog reference image signal;

an A-D converter module that converts either of the analog input image signal and the analog reference image signal selected by the signal selector module into a digital image signal according to preset characteristic data;

an image conversion processing module that generates a preset image signal, based on the digital image signal input from the A-D converter module;

a storage module that stores data, which corresponds to the characteristic data set in the A-D converter module, in an updatable manner; and a characteristic data setting module that sets the data stored in the storage module as the characteristic data in the A-D converter module, at a predetermined timing, the characteristic data setting module actuating the reference image signal generation module to generate the analog reference image signal, controlling the signal selector module to select the analog reference image signal, adjusting the characteristic data set in the A-D converter module to make image data expressed by the digital image signal input from the A-D converter module into the image conversion processing module approach to the reference image data, and updating the data stored in the storage module.

* * * * *